United States Patent [19]

Miyata et al.

[11] Patent Number: 4,847,180

[45] Date of Patent: Jul. 11, 1989

[54] SILVER HALIDE PHOTOGRAPHIC MATERIAL CAPABLE OF BEING HANDLED IN A BRIGHT ROOM DURING STEPS OF PHOTOMECHANICAL PROCESS

[75] Inventors: Junji Miyata; Ken-ichi Kuwabara; Toshiro Takahashi; Yoshio Inagaki; Shigeo Hirano, all of Kanagawa, Japan

[73] Assignee: Fuji Photo Film Co., Ltd., Kanagawa, Japan

[21] Appl. No.: 44,856

[22] Filed: May 1, 1987

[30] Foreign Application Priority Data

May 1, 1986 [JP] Japan ..... 61-99482

[51] Int. Cl.[4] ..... G03C 1/36

[52] U.S. Cl. ..... 430/264; 430/267; 430/606; 430/608; 430/613; 430/949

[58] Field of Search ..... 430/264, 949, 606, 613, 430/608, 267

[56] References Cited

U.S. PATENT DOCUMENTS

| | | | |
|---|---|---|---|
| 4,323,643 | 4/1982 | Mifune et al. | 430/949 |
| 4,552,837 | 11/1985 | Okazaki et al. | 430/613 |
| 4,681,836 | 7/1987 | Inoue et al. | 430/949 |
| 4,762,769 | 8/1988 | Takahashi et al. | 430/264 |

FOREIGN PATENT DOCUMENTS

| | | | |
|---|---|---|---|
| 52-65436 | 5/1977 | Japan | 430/949 |
| 60-140340 | 7/1985 | Japan . | |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide photographic material which may be handled in a bright room, which comprises a support having provided thereon at least one silver halide emulsion layer containing silver chlorobromide grains (bromide content: not more than 20 mol %) or silver chloride grains, said emulsion layer containing $1\times10^{-7}$ mol to $5\times10^{-4}$ mol of a rhodium salt per mol of silver, and said emulsion layer or at least one other hydrophilic colloid layer containing at least one hydrazine derivative represented by the following general formula (I):

$$R-X-\overset{\overset{\displaystyle O}{\|}}{C}-NH\left(L_1\right)_i\left(L_2\right)_j-A-NHNH\overset{\overset{\displaystyle O}{\|}}{C}-B \qquad (I)$$

wherein R represents an organic group having 1 to 30 carbon atoms; A represents a substituted or unsubstituted phenylene group or a substituted or unsubstituted naphthylene group; X represents —NH—or —O—; $L_1$ represents a straight, branched or cyclic alkylene group having 1 to 20 carbon atoms, an aralkylene group having 7 to 20 carbon atoms, a phenylene group, or a divalent group having 1 to 20 carbon atoms, wherein these groups are linked to each other through —O—, —S—, —CO—, —CONH—or —COO—; $L_2$ represents —CONH—, —$SO_2$NH—, —O—or —S—; i and j each independently represents 0 or 1; and B represents a hydrogen atom, a substituted or unsubstituted alkyl group having 1 to 20 carbon atoms, a substituted or unsubstituted phenyl group having 6 to 20 carbon atoms, a substituted or unsubstituted aralkyl group having a total of 7 to 20 carbon atoms and 1 to 3 carbon atoms in the alkyl moiety thereof, a substituted or unsubstituted alkoxy group haivng 1 to 20 carbon atoms, or a substituted or unsubstituted phenoxy group having 6 to 20 carbon atoms.

12 Claims, No Drawings

SILVER HALIDE PHOTOGRAPHIC MATERIAL CAPABLE OF BEING HANDLED IN A BRIGHT ROOM DURING STEPS OF PHOTOMECHANICAL PROCESS

FIELD OF THE INVENTION

This invention relates to a silver halide photographic material and, more particularly, to a bright room-type silver halide photographic material capable of being handled in a bright room during steps of the photomechanical process.

BACKGROUND OF THE INVENTION

In the steps of the photomechanical process in the field of duplication by printing, photographic images with continuous gradation are converted to halftone dot images wherein image density corresponds to the relative dot area, and are combined with originals of letters or line images to prepare printing originals.

In order to reproduce good line images and good halftone dot images, light-sensitive materials to be used for photomechanical process are required to provide enough high image contrast and enough high optical density to clearly discriminate image areas from non-image areas, or to show so-called superhigh contrast photographic properties (particularly 10 or more in gamma).

In recent years, photographic light-sensitive materials have been developed which can be handled in a bright room in spite of using silver halide as the light-sensitive element, thus meeting the demand for raising working efficiency by conducting a contact-exposure step (so-called contact work) using relatively low-speed light-sensitive materials in a brighter environment. The above-described demand can be met by a combination of a light-sensitive materials which has an extremely low sensitivity to visible light rays of 400 nm or longer in wavelength and a printer having a light source capable of emitting strong UV rays.

This type of silver halide photographic material which can be handled in a bright room have conventionally been prepared by adding inorganic desensitizing agents such as rhodium salts, iridium salts, cupric chloride, etc. upon formation of silver halide grains or by adding an organic desensitizing agent such as pinakryptol yellow, phenosafranine, etc. to an emulsion to thereby cause a substantial reduction in the intrinsic sensitivity of the silver halide emulsion to visible light rays (to the level of $1/10^4$ to $1/10^5$ of that of conventional emulsion).

On the other hand, in steps of the photomechanical process, it has been conventional to process a so-called lith type silver halide light-sensitive material comprising silver chlorobromide containing 40 mol% or less silver bromide with a hydroquinone developer (lith developer) having an extremely low effective concentration of sulfite ion (usually not more than 0.1 mol/-liter) to obtain superhigh contrast photographic properties (particularly 10 or more in gamma).

In this process, however, the developer is extremely unstable against aerial oxidation due to the low sulfite concentration of the developer.

Therefore, there has been desired an image-forming system which solves the problem of unstable image formation in the above-described lith development and which provides superhigh contrast photographic properties when developed with a processing solution having good storage stability. U.S. Pat. Nos. 4,166,742, 4,168,977, 4,221,857, 4,224,401, 4,243,739, 4,272,606, 4,311,781, etc. have proposed a system of forming a superhigh contrast negative image of more than 10 in gamma, which comprises processing a surface latent image-forming silver halide photographic material containing a specific acylhydrazine derivative with a developer of 10.5 to 12.3 in pH containing 0.15 mol/liter or more of a sulfite preservative and having a good storage stability.

In the above-described novel image-forming system, superhigh contrast gradation can be obtained by utilizing electron injection reaction of the hydrazine derivative into silver halide. Japanese Patent Application (OPI) No. 238049/86 (the term "OPI" as used herein means a "published unexamined patent application") describes the technique of incorporating the hydrazine derivative in the above-described system to obtain a silver halide photographic material which provides high contrast gradation and which can be handled in a substantially bright room. However, this system provides still insufficient contrast to attain good image reproducibility.

The above-described technique enables one to obtain a silver halide photographic material which provides contrast gradation when processed with a stable developer and which can be handled in a bright room. However, the contrast thus obtained is still insufficient for obtaining good image reproducibility, and the contrast gradation properties obtained immediately after preparation of light-sensitive material changes with time when stored under the conditions of high temperature and high humidity due to poor storage stability.

SUMMARY OF THE INVENTION

It is, therefore, an object of the present invention to provide a bright room-type silver halide photographic material which may be handled under a bright safe light (bright room) which provides extremely excellent superhigh contrast photographic properties when processed with a stable developer.

Another object of the present invention is to provide a bright room-type silver halide photographic material which keeps its superhigh contrast photographic properties even after storage (particularly under the conditions of high temperature and high humidity).

A further object of the present invention is to provide a bright room-type silver halide photographic material which can maintain its extremely excellent superhigh contrast photographic properties after storage (particularly under the conditions of high temperature and high humidity).

The terminology "bright room-type silver halide photographic material" as used herein refers to silver halide photographic materials which can be used for a long period of time (not less than 5 minutes) under safelight (200 lux) not having a wavelength in the ultraviolet portion but consisting substantially of a wavelength of 400 nm or longer without substantial changes in ,photographic properties such that the 50% dot image can be reproduced with the change in dot areas of not more than 2% and the increase in fog of not more than 0.02.

These and other objects of the present invention will become apparent from the following description thereof.

It has been found that the above-described and other objects of the present invention can be attained by a silver halide photographic material which may be handled in a bright room, which comprises a support having provided thereon at least one silver halide emulsion layer containing silver chlorobromide grains with a bromide content of not more than 20 mol% or silver chloride grains, said emulsion layer containing $1\times10^{-7}$ mol to $5\times10^{-4}$ mol of a rhodium salt per mol of silver, and said emulsion layer or at least one other hydrophilic colloid layer containing at least one hydrazine derivative represented by the following general formula (I):

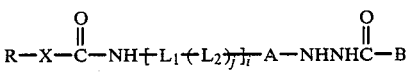

(I)

wherein R represents an organic group having 1 to 30 carbon atoms; A represents a substituted or unsubstituted phenylene group or a substituted or unsubstituted naphthylene group; X represents —NH— or —O —; $L_1$ represents a straight, branched or cyclic alkylene group having 1 to 20 carbon atoms, an aralkylene group having 7 to 20 carbon atoms, a phenylene group, or a divalent group having 1 to 20 carbon atoms, wherein these groups are linked to each other through —O—, —S—, —CO—, —CONH— or —COO—; $L_2$ represents —CONH—, —$SO_2$NH—, —O— or —S—; i and j each independently represents 0 or 1; and B represents a hydrogen atom, a substituted or unsubstituted alkyl group having 1 to 20 carbon atoms, a substituted or unsubstituted phenyl group having 6 to 20 carbon atoms, a substituted or unsubstituted aralkyl group having a total of 7 to 20 carbon atoms and 1 to 3 carbon atoms in the alkyl moiety thereof, a substituted or unsubstituted alkoxy group having 1 to 20 carbon atoms, or a substituted or unsubstituted phenoxy group having 6 to 20 carbon atoms.

DETAILED DESCRIPTION OF THE INVENTION

In the present invention, a specific hydrazine derivative or derivatives represented by the general formula (I) act on silver halide grains containing a high content of silver chloride and containing a large amount of rhodium salt as a desensitizing agent to obtain silver halide photographic materials having improved superhigh contrast photographic properties which may be handled in a bright room. In addition, it is extremely surprising that the light-sensitive material of the present invention has such an excellent preservability that it keeps its superhigh contrast photographic properties (of, particularly, 10 or more in gamma) even after being stored (particularly under the conditions of high temperature and high humidity).

Further, in the present invention, deterioration of the improved superhigh contrast photographic properties can be reduced even more by adding an amine compound together with the hydrazine derivative of the formula (I) to the above-described silver halide grains.

The hydrazine derivative of the general formula (I) is described in detail below.

As the organic group represented by R in the general formula (I), there are illustrated, for example, a substituted or unsubstituted alkyl group, a substituted or unsubstituted phenyl group, a substituted or unsubstituted naphthyl group, and a substituted or unsubstituted heterocyclic group (preferably a 5- or 6-membered heterocyclic group containing at least one of O, N and S atoms, which may optionally be fused with a benzene ring or other hetero ring).

R preferably represents a substituted or unsubstituted aliphatic, aromatic or heterocyclic group.

R contains preferably 7 to 20 carbon atoms.

Examples of the substituents optionally used for R, A, or B in the general formula (I) include a straight, branched, or cyclic alkyl group (containing preferably 1 to 20 carbon atoms); an aralkyl group (preferably a mono- or bicyclic aralkyl group containing 1 to 3 carbon atoms in the alkyl moiety thereof); an alkoxy group (containing preferably 1 to 20 carbon atoms); a mono- or di-substituted amino group (substituents being preferably an alkyl, acyl, alkylsulfonyl or arylsulfonyl group containing 1 to 20 carbon atoms and, when disubstituted, the sum of the number of carbon atoms of the substituents being 20 or less; a mono- to tri-substituted or unsubstituted ureido group (containing preferably 1 to 29 carbon atoms); a substituted or unsubstituted aryl group (preferably a mono- or bicyclic aryl group containing 6 to 29 carbon atoms); a substituted or unsubstituted arylthio group (containing preferably 6 to 29 carbon atoms); a substituted or unsubstituted alkylthio group (containing preferably 1 to 29 carbon atoms); a substituted or unsubstituted alkylsulfinyl group (containing preferably 1 to 29 carbon atoms); a substituted or unsubstituted arylsulfinyl group (containing preferably 6 to 29 carbon atoms and being of a mono- or bicyclic type); a substituted or unsubstituted alkylsulfonyl group (containing preferably 1 to 29 carbon atoms); a substituted or unsubstituted arylsulfonyl group (preferably a mono- or bicyclic arylsulfonyl group containing preferably 6 to 29 carbon atoms); an aryloxy group (preferably a mono- or bicyclic aryloxy group containing 6 to 29 carbon atoms); a carbamoyl group (containing preferably 1 to 29 carbon atoms); a sulfamoyl group (containing preferably 1 to 29 carbon atoms); a hydroxy group; a halogen atom (e.g., F, Cl, Br, I, etc.); a sulfonic acid group; a carboxylic acid group; etc.

Of these substituents, those which can further have a substituent or substituents may have as substituents an alkyl group (containing 1 to 20 carbon atoms); an aryl group (of a mono- or bicyclic type containing 6 to 20 carbon atoms); an alkoxy group (containing 1 to 20 carbon atoms); an aryloxy group (containing 6 to 20 carbon atoms); an alkylthio group (containing 1 to 20 carbon atoms); an arylthio group (containing 6 to 20 carbon atoms); an alkylsulfonyl group (containing 1 to 20 carbon atoms); an arylsulfonyl group (containing 6 to 20 carbon atoms); a carbonamido group (containing 1 to 20 carbon atoms); a sulfonamido group (containing 0 to 20 carbon atoms); a carbamoyl group (containing 1 to 20 carbon atoms); a sulfamoyl group (containing 1 to 20 carbon atoms); an alkylsulfinyl group (containing 1 to 20 carbon atoms); an arylsulfinyl group (containing 6 to 20 carbon atoms); an ester group (containing 2 to 20 carbon atoms); a hydroxy group; —COOM or —$SO_2$M (wherein M represents a hydrogen atom, an alkali metal atom, or a substituted or unsubstituted ammonium group); or a halogen atom (e.g., F, Cl, Br, I). These substituents may be linked to each other to form at least one ring.

Of the compounds represented by the general formula (I), particularly preferable compounds are those represented by the following general formula (IA):

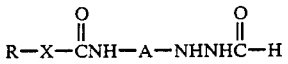

(IA)

wherein R, A, and X are the same as defined above.

Of the compounds represented by the general formula (IA), those wherein R has a partial structure of a branched alkyl group are particularly preferred.

Specific examples of the compounds represented by the general formula (I) are illustrated below which, however, are not to be considered limiting upon the present invention in any way.

(I-1)

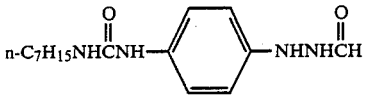

(I-2)

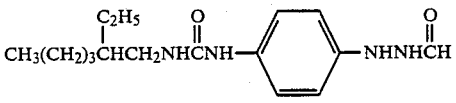

(I-3)

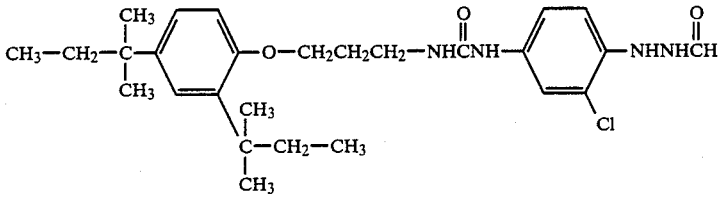

(I-4)

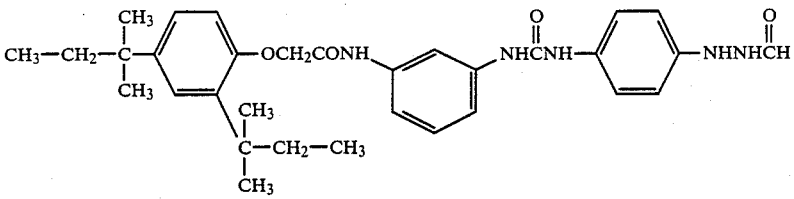

(I-5)

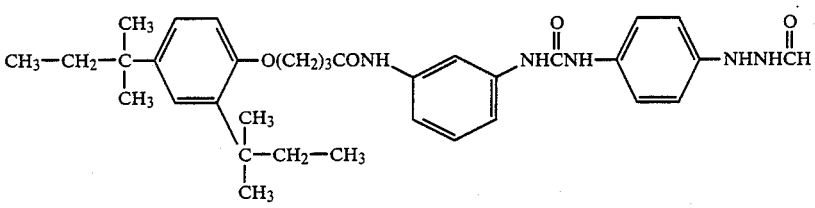

(I-6)

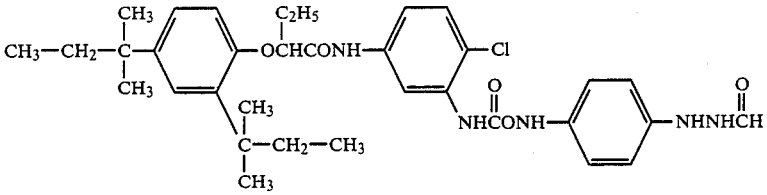

(I-7)

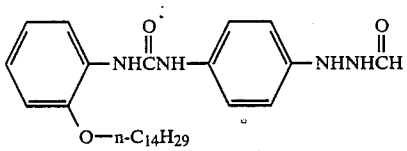

(I-8)

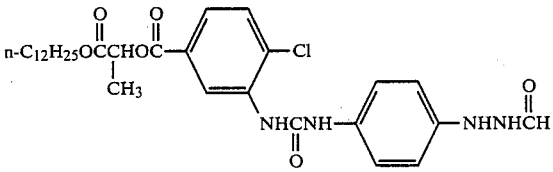

-continued
(I-9)
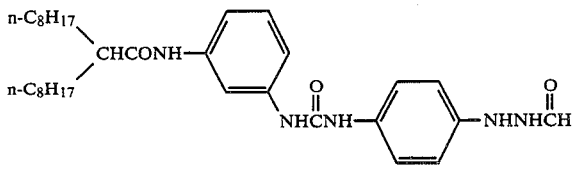
(I-10)
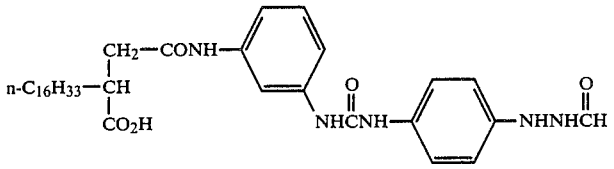
(I-11)
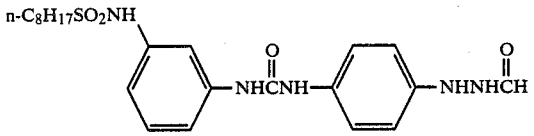
(I-12)
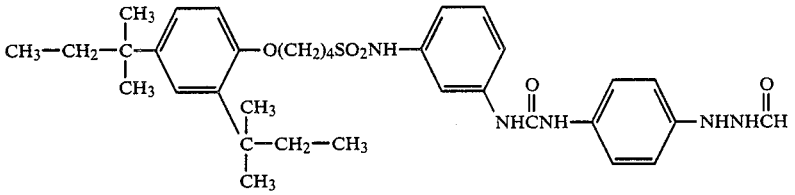
(I-13)
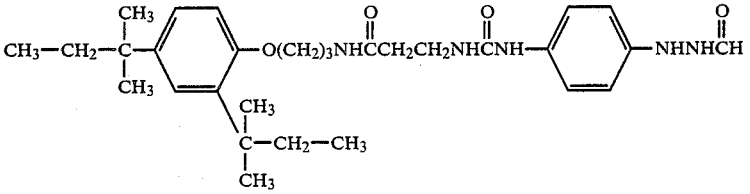
(I-14)
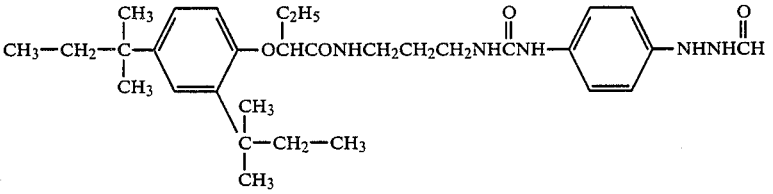
(I-15)
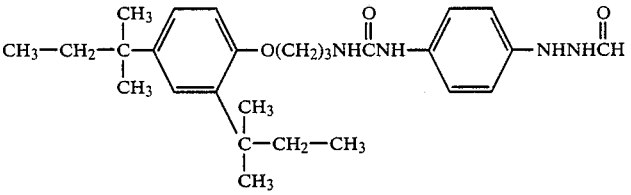
(I-16)
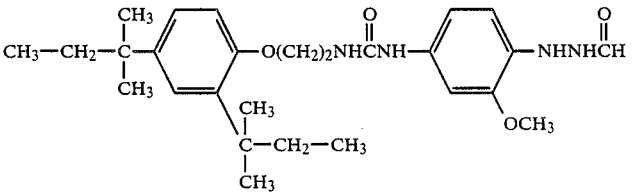

-continued (I-17)

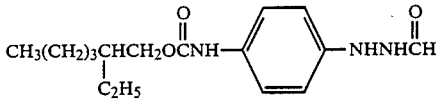

(I-18)

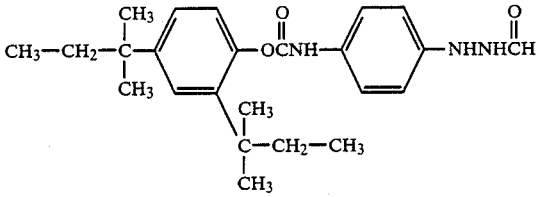

(I-19)

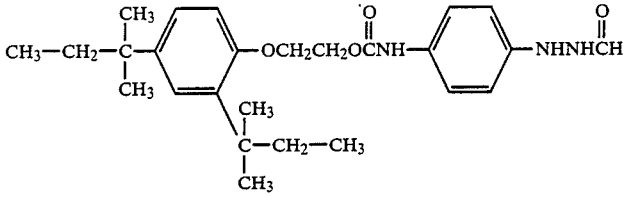

(I-20)

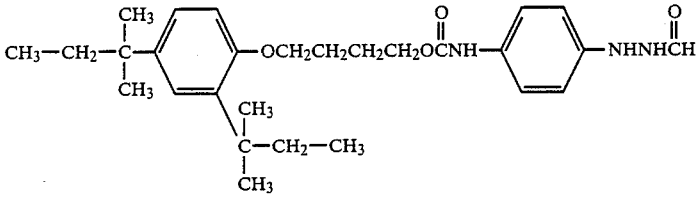

(I-21)

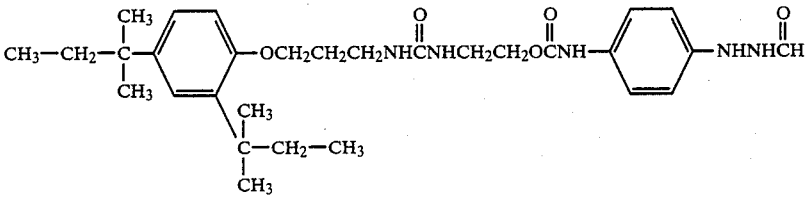

(I-22)

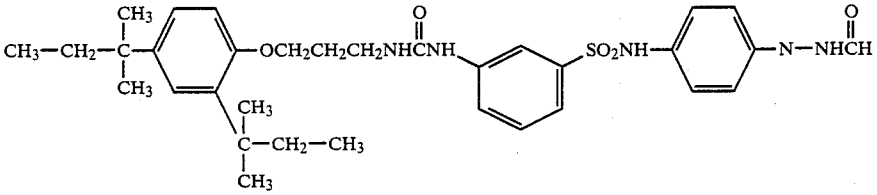

The hydrazine derivatives represented by the general formula (I) may be synthesized by reference to, Japanese Patent Application (OPI) No. 67843/81 or U.S. Pat. No. 4,560,638, etc.

For example, hydrazine derivatives of the general formula (I), wherein X represents —NH—, i.e., of the following general formula (IB):

$$R-NH\overset{O}{\overset{\|}{C}}-NH\left(L_1\left(L_2\right)_j\right)_i-A-NHNH\overset{O}{\overset{\|}{C}}-B \qquad \text{(IB)}$$

(wherein R, A, $L_1$, $L_2$, i, j, and B are the same as defined hereinbefore) may be obtained by:

(a) reacting an isocyanate of the following formula (III):

$$R-N=C=O \qquad \text{(III)}$$

with a hydrazine derivative of the following formula (IV):

$$H_2N\left(L_1\left(L_2\right)_j\right)_i-A-NHNH\overset{O}{\overset{\|}{C}}-B; \qquad \text{(IV)}$$

(b) reacting a urethane of the following formula (V):

(V)

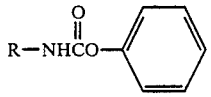

with the above-described hydrazine derivative (IV) in the presence of a base; or (c) reacting a urethane of the following formula (IV):

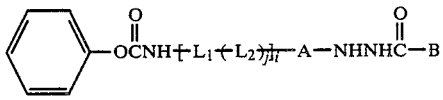

(VI)

with an amine of the formula (VII):

$$R-NH_2 \quad \text{(VII)}$$

preferably in the presence of a base (see, for example, Preparation Examples 1 to 7 below).

The hydrazine derivative to be used in the present invention is incorporated in an amount of preferably $1\times10^{-6}$ mol to $5\times10^{-2}$ mol, particularly preferably $1\times10^{-5}$ mol to $2\times10^{-2}$ mol, per mol of total silver halide.

In incorporating the hydrazine derivative to be used in the present invention in a photographic light-sensitive material, the water-soluble derivatives may be added as an aqueous solution and the water-insoluble derivatives may be added as a solution of a water-miscible organic solvent such as an alcohol (e.g., methanol, ethanol, etc.), an ester (e.g., ethyl acetate) or a ketone (e.g., acetone), to a silver halide emulsion solution or a hydrophilic colloidal solution.

The hydrazine derivatives of the present invention may be used alone or as a combination of two or more derivatives.

The hydrazine derivative may be added to a silver halide emulsion layer or other hydrophilic colloid layer. It suffices to incorporated the hydrazine derivative in at least one of these layers. The derivative may be added to both a silver halide emulsion layer and another hydrophilic colloid layer.

In the present invention, amine compounds exemplified by those represented by the following general formula (II) may preferably be used for more improved preservability of the resulting light-sensitive materials:

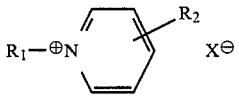

(II)

wherein:

$X^{\ominus}$represents an anion;

$R_1$ represents $-Y-R_3$, $-Y-COOR_3$, $-Y-OCOR_3$, $-Y'-COO-Y-OCOR_3$, $-Y'-OCO-Y-COOR_3$, or $-Y'-COO-Y-COOR_3$, wherein Y represents an alkylene group, an arylene group or an aralkylene group; and Y' represents a single bond, an alkylene group, an arylene group or an aralkylene group; $R_3$ represents an alkyl group, an aryl group, an aralkyl group,

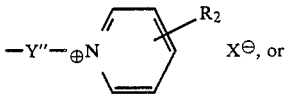

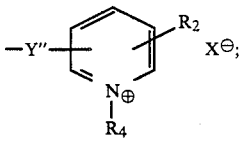

wherein $R_4$ represents an alkyl group, an aryl group or an aralkyl group; Y'' is the same as defined for Y'; and $R_2$ is the same as defined for $R_1$ or represents a hydrogen atom, a halogen atom, an alkyl group, an aryl group, an aralkyl group, an oxycarbonyl group, an acyloxy group, an alkoxy group, an amino group, a substituted amino group, an acylamido group, a sulfonamido group, a carbamoyl group, or

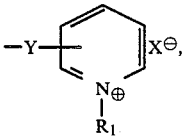

provided that at least one ester exists in $R_1$ or $R_2$.

Examples of groups represented by $X^{\ominus}$in the general formula (II) are inorganic anions such as halide ions (e.g., $F^{\ominus}$, $Cl^{\ominus}$, $Br^{\ominus}$ and $I^{\ominus}$), a perchlorate ion, a nitrate ion, a sulfate ion, $PF_6^{\ominus}$ and $OH^{\ominus}$ or organic acid ions such as an acetic acid ion, a benzoic acid ion, a methanesulfonic acid ion and a paratoluenesulfonic acid ion.

Specific examples are illustrated below.

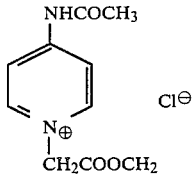

(II-1)

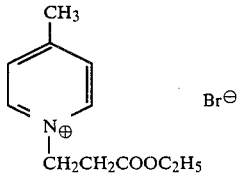

(II-2)

-continued
(II-3)
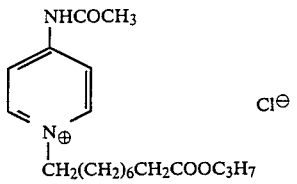
(II-4)
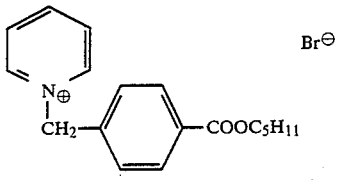
(II-5)
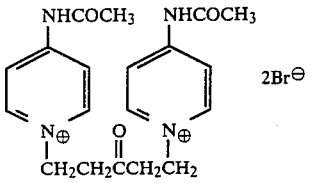
(II-6)
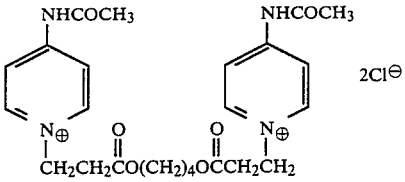
(II-7)
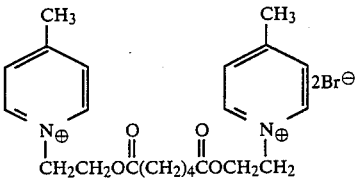
(II-8)
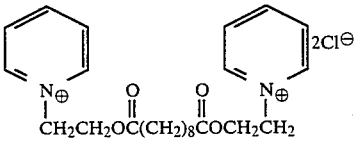
(II-9)
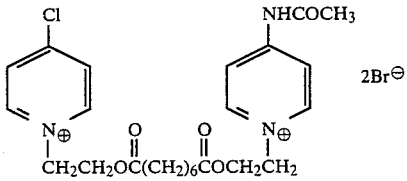
(II-10)
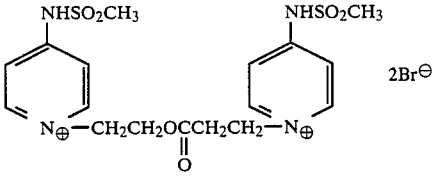
(II-11)
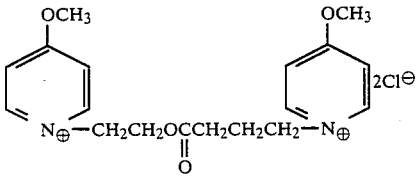

-continued (II-12)

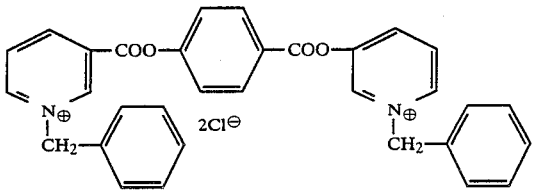

(II-13)

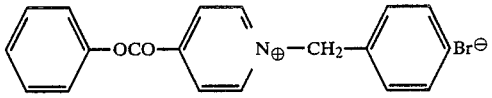

(II-14)

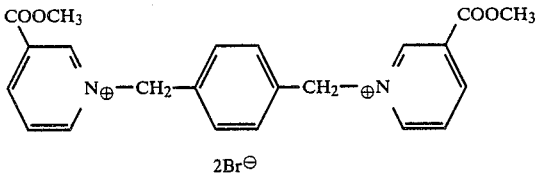

(II-15)

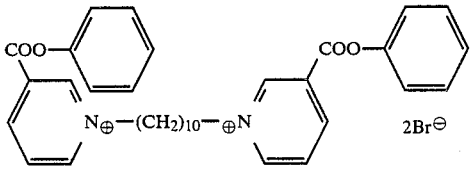

(II-16)

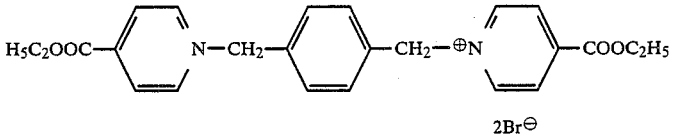

(II-17)

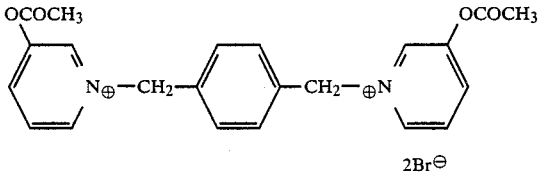

The present invention, however, is not limited by the above examples.

The amine compounds of the general formula (II) are known as development accelerators for lith development (infectious development) for attaining high contrast by the development-restraining effect of a polyoxyethylene compound, as shown in Japanese Patent Publication No. 33780/82. However, its is extremely surprising that, in the system of attaining high contrast by the action of hydrazine derivatives, the stability of the superhigh contrast gradation obtained by the hydrazine derivative of the general formula (I) can be maintained by using the amine compound.

The amine compound to be used in the present invention is incorporated in an amount of preferably $1\times10^{-5}$ to $5\times10^{-2}$ mol, particularly preferably $5\times10^{-5}$ to $1\times10^{-2}$ mol, per mol of total silver halide.

The amine compounds may be used aline or as a combination of two or more compounds.

The amine compounds may be incorporated in a light-sensitive material by adding them to a silver halide emulsion solution to a sydrophilic colloid solution as a solution dissolved in an appropriate solvent (for example, water, methanol, ethanol, or a mixture thereof).

Layers to which the amine compound is added are not particularly limited and may be any of silver halide emulsion layers and other hydrophilic colloid layers. The objects of the present invention my be attained by incorporating the amine compound or compounds in at least one of these layers. Of course the compound may be added to both the emulsion layer and other hydrophilic layer. The compound may be added to the same layer to which the rhodium salt and/or the hydrazone derivative of the present invention is added, or to a different layer.

In the present invention, one or more water-soluble rhodium salts are used for the purpose of decreasing sensitivity of the silver halide emulsion to thereby improve handling properties of the resulting light-sensitive materials in a bright room. Typically, rhodium chloride, rhodium trichloride, rhodium ammonium chloride, etc. are preferable. In addition, complex salts thereof may also be used.

Addition of the above-described rhodium salt may be conducted at any stage before completion of first ripening in the emulsion preparation, but is desirably conducted during grain formation. The salt is added in an amount of $1\times10^{-7}$ mol to $5\times10^{-4}$ mol, particularly preferably $1\times10^{-6}$ mol to $1\times10^{-4}$ mol, per mol of silver. If the amount of the rhodium salt exceeds the upper limit, enough tone contrast is not obtained, whereas if lower than the lower limit, the result is poor safe light properties. Thus, the results above and below the above limits are unfavorable.

In the light-sensitive material of the present invention, when an organic desensitizing agent has a polarographic anode potential and cathode potential such that the net value is positive may be used together with the rhodium salt to reduce sensitivity. As the organic desensitizing agent, those desensitizing agents which are described in *Research Disclosure,* Vo. 167, RD No. 16735 (Mar. 1978), p. 67, right col., ibid., Vol. 176, RD No. 17643 (December, 1978), p. 23, Section J and p. 24, Section K may be used.

The silver halide emulsion of the present invention is preferably not subjected to chemical ripening.

The phrase "not subjected to chemical ripening" as used herein means not to conduct the conventionally employed sensitization step of adding a sulfur sensitizer capable of reacting with a silver salt to form silver sulfide, a reduction sensitizer such as a stannous salt or an amine, or a noble metal sensitizer such as a chloroaurate or a gold trichloride, or an active gelatin containing a sulfur-containing compound, and sensitizing at a given temperature and a pH for a given period of time. This preference does not exclude sinsitization by an extremely slight amount of sensitizer contained in gelatin usually called inert gelatin.

The silver halide of the silver halide photographic material to e used in the present invention is silver chloride or silver chlorobromide containing not more than 20 mol %, more preferably not more than 10 mol %, of silver bromide.

The silver halide grains preferably have an average grain size of not more than 0.5 μm, more preferably not more than 0.3 μm. The term "average grain size" is commonly used by those skilled in the silver halide photographic art and is well understood. The term "grain size" means the diameter of the grains when the grains are spherical or approximately spherical. With cubic grains, the grain size refers to the length of an edge $$x\sqrt{\frac{4}{\pi}}.$$

The average grain size is determined as an algebraic average or geometric average based on the projected area of the grains. Details of the measurement of the average grain size are described in C. E. Mees & T. H. James, *The Theory of the Photographic Process,* 3rd Ed., pp. 36 to 43 (Macmillan, 1966).

The silver halide grains are not limited as to form and may be in any of tabular form, spherical form cubic form, octahedral form, etc. The grains preferably have a narrow grain size distribution. In particular, so-called monodispersed emulsions wherein 90% on a number basis of the total silver halide grains have a grain size within ±40% of the average grain size are preferred.

As a method of reacting a soluble silver salt with a soluble halide salt, and of single jet process, double jet process, and their combination may be employed.

A process of forming grains in the presence of excess silver ion (called a reverse mixing process) can be employed as well. An example of the double jet process is the controlled double jet process, wherein pAg is a liquid phase in which silver halide is formed is kept constant. This process provides a silver halide emulsion containing silver halide grains of regular crystal form having an approximately uniform grain size.

Grain formation is preferably conducted under acidic conditions. Our experiments have revealed that the effects of the present invention are decreased under neutral and alkaline conditions. The preferred pH is not higher than 6, more preferably not higher than 5.

The silver halide emulsion of the light-sensitive material to be used in the present invention may be a single emulsion or a mixture of two or more emulsions (for example, emulsions having different average grain size or different halide compositions).

The silver halide emulsion layer may be a single layer, but two or more silver halide emulsions layers may be provided. The emulsion is desirably coated in a silver amount of 1 g/m$^2$ to 8 g/m$^2$. Where two or more emulsion layers are provided, the rhodium salt is preferably incorporated in all of the emulsion layers.

In the light-sensitive material of the present invention may be further incorporated various compounds for the purpose of preventing formation of fog in producing, storage, or photographic processing of the light-sensitive materials. That is, many compounds such as azoles (e.g., benzothiazolium salts, nitroindazoles, nitrobenzimdazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazoles), etc.; mercaptopyrimidines; mercaptotriazines; thioketo compounds, tetrazaindenes (particularly 4-hydroxy-substituted (1,3,3*a*,7)tetrazaindenes), pentazaindenes, etc.); enzenethiosulfonic acid; benzenesulfinic acid; benzenesulfonic acid amide; etc. known as antifoggants or stabilizers may be added.

Various dyes (for example, ultraviolet ray-absorbing dyes) may be incorporated in the dydrophilic colloidal layers of the photographic light-sensitive material in accordance with the present invention for the purpose of preventing irradiation, imparting safe light aptitude, and the like.

As the ultraviolet ray-absorbing dyes, there may be used benzotriazole compounds substituted by an aryl group, 4-thiazolidone compounds, benzophenoone compounds, cinnamic acid ester compounds, butadiene compounds benzoxazole compounds, ultraviolet ray-absorbing polymers.

These dyes may be fixed in a hydrophilic colloid layer formed on or above the emulsion layer as is described in Japanese Patent Application (OPI) No. 198148/86.

Further, as dyes which are to be added for the purpose of improving handling properties in a bright room, those which reduce the sensitivity of the silver halide emulsion to light rays of 400 nm or longer among the intrinsic light-sensitive wavelength region are preferable, and those dyes which have an absorption maximum in the range of from 420 to 550 nm when incorporated in a film coating are preferably used. Such dyes are not particularly limited as to chemical structure and oxonol dyes, hemioxonol dyes, merocyanine dyes, cyanine dyes, axo dyes, arylidene dyes, etc. may be used. However, in view of removing residual color after photographic processing, water-soluble dyes are useful.

Specifically, there may be used pyrazoloneoxonol dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284, and 3,718,472, enamihemioxonol dyes described in U.S. Pat. No. 3,976,661, arylidene dyes described in Japanese Patent Application (OPI) Nos. 3623/76 and 20822/77, bis type dyes described in Japanese Patent Application (OPI) Nos. 213839/80, and 21306/85, 117456/85, and 178324/85, and dyes described in British Patent Nos. 584,609 and 1,177,429, Japanese Patent Application (OPI) Nos. 85130/73, 99620/74, and 114420/74, and U.S. Pat. Nos. 2,533,472, 3,148,187, 3,177,078, 3,247,127, 3,540,887, 3,575,704, and 3,653,905.

These dyes may be added to a silver halide emulsion or a dydrophilic colloid directly or those previously dissovled in water or an organic solvent may be added thereto. In addition, they may be used in combination with a mordant.

The dye is incorporated in an amount of preferably 10 mg to 400 mg, particularly preferably 20 to 300 mg, per $m^2$ of a light-sensitive material.

The photographic emulsion and light-insensitive hydrophilic colloid of the present invention may contain an inorganic or organic hardener. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, bis(vinylsulfonyl)methyl ether, N,N'-methylenebis-(β-(vinylsulfonyl)propionamide, etc.), active halogen compounds (e.g., 2,4-dichloro-6-hydroxy-s-triazine, etc.), mucohalogenic acids (e.g., mucochloric acid, mucophenoxychloric acid, etc.), isoxazoles, dialdehydo-starch, 2-chloro-6-hydroxytriazinylated gelatin, etc. may be used alone or in combination. Of these, active vinyl compounds described in Japanese Patent Application (OPI) Nos. 41221/78, 57257/78, 162546/84, and 80846/85 and active halogen compounds described in U.S. Pat. No. 3,325,287 are preferable.

The light-sensitive emulsion layer and/or the light-insensitive hydrophilic colloid layer of the present invention may contain various known surfactants for various purposes, e.g., as a coating aid, for preventing the generation of static charges, improving sliding properties, improving emulsion dispersion, preventing adhesion, improving photographic properties (e.g., accelerating development, increasing contrast, sensitization, etc.), etc. For the purpose of preventing the generation of static charges, fluorine-containing surfactants described in Japanese Patent Application (OPI) No. 80849/85 are preferable.

Although gelatin is advantageously used as the binder or protective colloid for the photographic emulsions used in the present invention, other hydrophilic colloids may also be used in this invention. For example, proteins such as gelatin derivatives, graft polymers of gelatin with other high molecular weight materials, albumin or casein, etc., cellulose derivatives such as hydroxyethylcellulose, carboxymethylcellulose or cellulose sulfate, etc., saccharide derivatives such as sodium alginate or starch derivatives, etc., and synthetic hydrophilic high molecular weight materials such as homo- or copolymers, for example, polyvinyl alcohol, partially acetallized polyvinyl alcohol, poly-N-vinylpyrrolidone, polyacrylic acid, polymethacrylic acid, polyacrylamide, polyvinylimidazole or polyvinylpyrrazole, etc. may be used.

As gelatin, acid-processed gelatin may be used as well as lime-processed gelatin, and a gelatin hydrolyzate or an enzyme-decomposed product of gelatin may also be used.

The photographic light-sensitive material of the present invention preferably contains an acid group-containing compound in its silver halide emulsion layer and other layer. As the acid group-containing compound, organic acids such as salicylic acid, acetic acid, ascorbic acid, etc. and homo- or copolymers containing as repeating units acid monomers such as acrylic acid, maleic acid, phthalic acid, etc. may be illustrated. As to these compounds, reference may be made to Japanese Patent Application (OPI) Nos. 228334/86 and 228437/86, and Japanese Patent Application Nos. 163856/85 and 195655/85. Of these compounds, ascorbic acid is particularly preferable as a low molecular compound, and a water-dispersible latex of copolymer comprised of an acid monomer such as acrylic acid and a cross-linkable monomer having two or more unsaturated groups such as divinylbenzene is particularly preferable as a high molecular compound.

The photographic emulsion used in this invention may contain a dispersion of a synthetic polymer which is water-insoluble or sparingly water-soluble for the purpose of improving the dimensional stability, or for other purposes. Examples of the polymers include polymers comprised of one or more of alkyl acrylates or methacrylates, acrylates or methacrylates, glycidyl acrylates or methacrylates, etc., and polymers comprising a combination of the above-described monomers and acrylic acid, methacrylic acid, or the like.

In order to form an image according to the present invention, it is advantageous to expose the light-sensitive material using light rays substantially not containing light with a wavelength not more than 370 nm. Specific techniques for conducting such exposure include, for example, a technique of incorporating an ultraviolet ray absorbent in the light-sensitive material; a technique of using an optical filter which absorbs ultraviolet rays; and a technique of using a light source which substantially does not emit light with a wavelength not more than 370 nm.

The first technique is described below.

The ultraviolet ray absorbent is used in an enough amount to reduce the intrinsic sensitivity of a light-sensitive emulsion to ½ or lower than its original sensitivity. As the ultraviolet ray absorbents, those which have an absorption peak in a range of 300 to 400 nm may be used, with those having an absorption peak in a region of 300 to 380 nm being more preferable.

As the ultraviolet ray absorbents, there may be used, for example, aryl-substituted benzotriazole compounds, 4-thiazolidone compounds, benzophenone compounds, cinnamic acid ester compounds, butadiene compounds, benzoxazole compounds, azo compounds, and ultraviolet ray-absorbing polymers.

Specific examples of the ultraviolet ray absorbents are described in U.S. Pat. Nos. 3,533,794, 3,314,794 and 3,352,681, Japanese Patent Application (OPI) No.

2784/71, U.S. Pat. Nos. 3,705,805, 3,707,375, 4,045,229, 3,700,455 and 3,499,762, West German Patent Publication No. 1,547,863, etc.

In the present invention, the ultraviolet ray absorbent is added so as to reduce the intrinsic sensitivity of a silver halide emulsion at 360 nm and is added in such amount that the absorbance at 360 nm becomes 0.3 or more, more preferably 0.4 or more.

Specifically, the ultraviolet ray absorbent is added usually in an amount of $10^{-2}$ g/m$^2$ to 1 g/m$^2$, preferably 50 mg to 500 mg/m$^2$, though it depends upon the molar absorptivity of the particular ultraviolet ray absorbent.

The ultraviolet ray absorbent of the present invention is incorporated in an emulsion layer, a surface protective layer, an interlayer, etc., preferably in a surface protective layer.

The above-described ultraviolet ray absorbent may be added to a coating solution for forming a light-insensitive hydrophilic colloid layer of the present invention by dissolving in an appropriate solvent such as water, alcohol (e.g., methanol, ethanol, propanol, etc.), acetone, methylcellosolve, etc., or a mixture thereof.

These ultraviolet ray absorbents may be used in combinations of two or more absorbents.

In the present invention, the aforesaid safe light dye and the above-described ultraviolet ray absorbent may be incorporated in the same layer or in different layers.

In the second technique, the preferred optical filter (i.e., filter for a light source) which absorbs ultraviolet rays is one which scarcely transmits light with a wavelength not more than 370 nm, such as Sharp-cut filters, SC-38, SC-39, SC-40, SC-41, etc. made by Fuji Photo Film Co., Ltd. More specifically, filters which do not transmit more than 20%, more preferably not more than 10%, of light not more than 370 nm in wavelength are preferred.

In the third technique, the light source which substantially does not have a light-emitting energy in a region not more than 370 nm, may, for example, be EYE DOLPIN made by EYE GRAPHICS Co., Ltd., a light source for printer for Photomechanical process such as P-603 made by Dainippon Screen Mfg. Co., Ltd. (metal halide lamp: TYPE SPG-2000 (2 kw) made by Japan Storage Battery Co., Ltd.), etc.

As the light source to be used in this third technique, those light sources are preferable which have such light-emitting energy distribution that a light-emitting energy in the region of 300 to 370 nm is not more than 30%, particularly not more than 20%, of that in the region of 300 to 420 nm.

In the case of conducting exposure by placing an ultraviolet ray-absorbing optical filter between a light source and a light-sensitive material, conventionally known light sources may be used when a layer containing an ultraviolet ray absorbent or the like is provided in the light-sensitive material so that light rays substantially not containing light with a wavelength not more than 370 nm may reach the light-sensitive layer. Examples of such known light sources include a light source for printer for photomechanical process such as P-607 made by Dainippon Screen Mfg. Co., Ltd. (superhigh pressure mercury lamp; OCR-CHM-1000), a light source for P-627FM made by the same company, etc.

In the process of the present invention, exposure time is selected depending upon the capacity of a particular light source used and the sensitivity of light-sensitive material (including spectral sensitivity), but as a general guide, exposure is conducted for 60 to 5 seconds. In some cases, exposure may be conducted for a long time (2 to 3 minutes).

In order to obtain superhigh contrast photographic properties using the above-described silver halide light-sensitive material, it is not necessary to use a conventional infectious developer or a highly alkaline developer having a pH of approximately 13 described in U.S. Pat. No. 2,419,975. A stable developer may be used.

That is, the above-described silver halide light-sensitive material permits the use of a developer which contains sulfite ion as a preservative (particularly 0.15 mol/liter or more), and can provide an enough superhigh contrast negative image when processed with a developer of 9.5 or more, particularly 10.5 to 12.3, in pH.

Developing agents used in the developer to be used in the present invention are not particularly limited, but in view of readily obtained good halftone dot quality, dihydroxybenzenes are preferably contained therein. In some cases, a combination of a dihydroxybenzene and a 1-phenyl-3-pyrazolidone or a combination of a dihydroxybenzene and a p-aminophenol is employed.

The dihydroxybenzene developing agents which may be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., with hydroquinone being particularly preferable.

1-Phenyl-3-pyrazolidone and the derivatives which may be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

The p-aminophenolic developing agents which may be used in the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc., with N-methyl-p-aminophenol being particularly preferable.

The developing agent is usually used in an amount of 0.05 mol/liter to 0.8 mol/liter. In the case of employing a combination of a dihydroxybenzene and a 1-phenyl-3-pyrazolidone or a p-aminophenol, the former is used preferably in an amount of 0.05 mol/liter to 0.5 mol/liter and the latter in an amount of not more than 0.06 mol/liter.

The sulfite preservatives which may be used in the present invention include sodium sulfite, potassium sulfite, lithium sulfite, ammonium sulfite, sodium bisulfite, metapotassium bisulfite, formaldehyde-sodium bisulfite, etc., for example. The sulfite is preferably used in an amount of 0.4 mol/liter or more, particularly preferably 0.5 mol/liter or more. The upper limit thereof is preferably 2.5 mol/liter.

The alkali agents to be used for adjusting pH include pH-adjusting agents such as sodium hydroxide, potassium hydroxide, sodium carbonate, potassium carbonate, etc., and buffering agents such as boric acid described in Japanese Patent Application No. 28708/86, sugars (e.g., sucrose) described in Japanese Patent Application (OPI) No. 93433/85, oxiums (e.g., acetooxium), phenols (e.g., 5-sulfosalicylic acid), tertiary phosphates (e.g., sodium salts, potassium salts, etc.), etc.

As the additives which may be used in the present invention other than the above-described components, development restrainers such as boric acid, borax, sodium bromide, potassium bromide, potassium iodide, etc.; organic solvents such as ethylene glycol, diethylene glycol, triethylene glycol, dimethylformamide, methylcellosolve, hexylene glycol, ethanol, methanol, etc.; antifoggants or black pepper-preventing agents such as mercapto compounds (e.g., 1-phenyl-5-mercaptotetrazole, 2-mercaptobenzimidazole-5-sulfonate sodium salt, etc.), indazole compounds (e.g., 5-nitroindazole), benzotriazole compounds (e.g., 5-methylbenzotriazole), etc. and, if necessary, toning agents, surfactants, defoaming agents, hard water softeners, hardeners, amino compounds as described in Japanese Patent Application (OPI) No. 106244/81, etc. may be incorporated.

As a fixing agent, those with a commonly employed formulation may be used. As fixing agents, organic sulfur compounds known to function as fixing agents may be used as well as thiosulfates and thiocyanates. The fixing solution may contain a water-soluble aluminum compound (e.g., aluminum sulfate, alum, etc.) as a hardener. The water-soluble aluminum salt is added in an amount of usually 0 to 1.4 g-Al/liter.

Further, a trivalent iron compound may be used as an oxidant in the form of a complex with ethylenediaminetetraacetic acid.

Processing temperatures are usually selected from 18° C. to 50° C., preferably from 25° to 43° C.

The support used in the present invention is not specifically limited. Examples of the support include cellulose triacetate, cellulose diacetate, nitrocellulose, polystyrene, polyethylene terephthalate, etc.

The present invention is now illustrated in greater detail by reference to the following examples which, however, are not to be construed as limiting the present invention in any way.

PREPARATION EXAMPLE 1

Synthesis of hydrazine derivative (I-4)

(1) Synthesis of 2-{4-[3-(3-nitrophenyl)ureido]phenyl}-1-formylhydrazine:

200 ml of acetonitrile and 200 ml of N,N-dimethylformamide were added to 60.4 g of 2-(4-aminophenyl)-1-formylhydrazine to prepare a solution, and the solution was cooled to −5° C. To this was dropwise added a solution of 65.6 g of m-nitrophenylisocyanate in 200 ml of acetonitrile, during which the solution was cooled under stirring so as not to exceed −5° C. Then, 300 ml of acetonitrile was further added thereto and, after stirring the solution for 3 hours at 0° C., the crystals formed were collected by filtration, washed with successive washings of acetonitrile and methanol. The thus obtained crystals were dissolved in 1 liter of N,N-dimethylformamide and, after filtering off insoluble, 3 liters of methanol was added to the filtrate, followed by cooling it to form crystals. The crystals were collected by filtration, then washed with successive washings of acetonitrile and methanol. Yield: 98.5 g.

(2) Synthesis of 2-{4-[3-(3-aminophenyl)ureido]-phenyl}-1-formylhydrazine:

138 g of iron powder, 5 g of ammonium chloride, 2.45 liters of dioxane, and 985 ml of water were mixed and heated over a steam bath under stirring. 98 g of the nitro compound obtained in (1) above was added thereto, followed by refluxing the solution for an additional 40 minutes. Then, after insolubles were filtered off, the filtrate was concentrated under reduced pressure and water was added thereto. The crystals formed were collected by filtration and washed with acetonitrile. Yield: 79 g.

(3) Synthesis of hydrazine derivative (I-4):

4 g of the amino compound obtained in (2) above was dissolved in 20 ml of N,N-dimethylacetamide, then 20 ml of acetonitrile and 1.4 g of triethylamine were added thereto, followed by cooling the solution to −5° C. 4.4 g of (2,4-di-tert-pentylphenoxy)acetyl chloride was dropwise added thereto, during which the solution was cooled under stirring so as not to exceed 0° C. After stirring the solution for 1 hour at 0° C. and 2 hours at room temperature, it was poured into 800 ml of water to precipitate crystals. The crystals formed were collected by filtration and recrystallized from acetonitrile. Yield: 4.8 g; m.p. 152°–154° C.

PREPARATION EXAMPLE 2

Synthesis of hydrazine derivative (I-5)

60 ml of N,N-dimethylacetamide, 60 ml of acetonitrile, and 4.01 g of triethylamine were added to 11.4 g of the amino compound obtained in (2) of Preparation Example 1, and the solution was cooled to 0° C. 13.5 g of 4-(2,4-di-tert-pentylphenoxy)butyroyl chloride was dropwise added thereto, during which the solution was cooled under stirring so as not to exceed 5° C. After stirring the solution for 1.5 hours, water was added thereto to precipitate crystals. The crystals formed were collected by filtration and recrystallized from acetonitrile. Yield: 11.2 g; m.p. 207°–209° C.

PREPARATION EXAMPLE 3

Synthesis of hydrazine derivative (I-13)

10 ml of N,N-dimethylacetamide and 0.9 ml of triethylamine ethylamine were added to 2.5 g of 3-[3-(2,4-di-t-pentylphenoxy)propylcarbamoylamino]propionic acid, then the solution was cooled to −15° C. 0.61 ml of ethyl chloroformate was dropwise added thereto so as not to exceed −5° C., and stirring was continued for 15 minutes at −10° C. Then, 0.97 g of 2-(4-aminophenyl)-1-formylhydrazine dissolved in 7 ml of N,N-dimethylacetamide was added thereto. After continuing for 30 minutes at −30° C., the solution was stirred for 30 minutes at room temperature, then poured into an ice-cooled 2% aqueous solution of sodium hydrogen carbonate. The crystals formed were collected by filtration, washed with water, and recrystallized from 25 ml of acetonitrile. Yield: 1.9 g; m.p. 181.5° C.

PREPARATION EXAMPLE 4

Synthesis of hydrazine derivative (I-15)

300 ml of N,N-dimethylacetamide, 30 ml of triethylamine, and 58.3 g of 3-(2,4-di-tert-pentylphenoxy)propylmine were added to 54.2 g of 2-(4-phenoxycarbonylaminophenyl)-1-formylhydrazine synthesized from phenyl chloroformate and 2-(4-aminophenyl)-1-formylhydrazine, and the solution was heated at 60° C. for one hour under stirring. After being cooled to 30° C., the solution was poured into a mixture of 900 ml of 0.5 mol/liter of hydrochloric acid and 700 ml of ethyl acetate. The organic layer was separated out, concentrated, and dissolved in 350 ml of acetonitrile. Then 1 liter of water was added thereto and the crystals formed were collected by filtration and washed with water. The crystals were dissolved in 600 ml of acetonitrile by heating and, after adding thereto 3 g of active carbon, hot filtration was conducted. After being cooled to room temperature, the filtrate was stirred for one hour, then ice-cooled until the temperature inside became 5° C. under stirring. The crystals thus formed were collected by filtration and washed with 150 ml of acetonitrile. Yield: 69.2 g; m.p. 158°–160° C.

PREPARATION EXAMPLE 5

Synthesis of hydrazine derivative (I-22)

A solution of 6.5 g of 3-(2,4-di-tert-amylphenoxy)-propylamine and 4.5 g of triethylamine in 10 ml of ethyl acetate was dropwise added to a solution of 2.3 g of trichloromethyl chloroformate in 50 ml of ethyl acetate while stirring under ice-cooling. After reacting for an additional 2 hours at room temperature, solids were filtered off and the filtrate was concentrated. To this concentrate was added 6.7 g of 2-(3-aminobenzenesulfonamidophenyl)-1-formylhydrazine obtained by reacting 2-(4-aminophenyl)-1-formylhydrazine with m-nitrobenzenesulfonyl chloride and subjecting the reaction product to neutral reduction with iron dust. The product was heated to 30° C. in 30 ml of dimethylformamide under stirring. After reacting for two hours, water was added to the reaction solution and rubber-like solids were separated and purified by silica gel column chromatography (developing solvent: a mixture of chloroform and methanol; ratio: changed from 20/1 to 10/1) to obtain the end product. Yield: 4.5 g (33%); softening point: 120° C.

PREPARATION EXAMPLE 6

Synthesis of hydrazine derivative (I-10)

8.6 g of the amino compound obtained in (2) of Preparation Example 1 and 9.7 g of hexadecylsuccinic acid anhydride were dispersed in 100 ml of acetic acid and the reaction was conducted at 50° C. for 10 hours. After allowing the contents of the reaction vessel to cool, the crystals precipitated were collected by filtration and 30 ml of dimethylformamide and 0.5 g of active carbon were added thereto to dissolve under heating, followed by filtration. 120 ml of acetonitrile was added to the filtrate, and the precipitated crystals were collected by filtration to obtain 9.9 g of the end product. Heat decomposition point: 183°–185° C.

PREPARATION EXAMPLE 7

Synthesis of hydrazine derivative (I-12)

30 ml of N,N-dimethylacetamide, 30 ml of acetonitrile, and 4.4 g of triethylamine were added to 8.6 g of the amino compound obtained in (2) of Preparation Example 1, then ice-cooled to 3° C. 16.3 g of 4-(2,4-di-tert-pentylphenoxy)butanesulfonyl chloride was dropwise added to the mixture, and the reaction was further conducted for 3 hours under ice-cooling. 150 ml of water was added to the reaction solution, and a separated waxy product was purified by silica gel column chromatography (developing solvent: a mixture of ethyl acetate and hexane; mixing ratio: changed to 1/10 - 1/1 - 5/1). The thus obtained solids were dissolved in 40 ml of ethanol and filtered, followed by adding 100 ml of hexane to conduct recrystallization. Thus, 4.9 g of the end product was obtained. Softening point: 140°–143° C.

Examples of the present invention will be given below to describe the advantages of the present invention.

EXAMPLE 1

Four emulsions A, B, C and D were prepared according to the following procedures using solutions I and II described below.

Solution I: 300 ml water; 9 g gelatin

Solution II: 100 g $AgNO_3$; 400 ml water.

(1) Emulsion A (not containing Rh):

Solution IIIA: 37 g NaCl; 400 ml water

To Solution I kept at 45° C. were simultaneously added Solution II and Solution IIIA at a constant rate. After removing soluble salts by the flocculation process well known in the photographic art, gelatin was added to the solution. Then, 6-methyl-4-hydroxy-1,3,3*a*,7-tetrazaindene was added thereto in an amount of $5\times10^{-3}$ mol per mol of Ag for the purpose of preventing fog. This emulsion had an average grain size of 0.20 μm, and the amount of gelatin was 60 g per kg of the resulting emulsion.

(2) Emulsion B (Rh: $3\times10^{-6}$ mol/mol Ag):

Solution IIIB: 37 g NaCl; 0.6 mg $(NH_4)_3RhCl_6$; 400 ml water

Emulsion B was prepared in the same manner as with Emulsion A except for using Solution IIIB in place of Solution IIIA.

(3) Emulsion C (Rh: $6\times10^{-6}$ mol/mol Ag):

Solution IIIC: 37 g NaCl, 0.6 mg $(NH_4)_3RhCl_6$; 400 ml water

Emulsion C was prepared in the same manner as with Emulsion A except for using Solution IIIC in place of Solution IIIA.

(4) Emulsion D (Rh: $3\times10^{-5}$ mol/mol Ag):

Solution IIID: 37 g NaCl; 6 mg $(NH_4)_3RhCl_6$; 400 ml water

Emulsion D was prepared in the same manner as with Emulsion A except for using Solution IIID in place of Solution IIIA.

To each of these emulsions was added the hydrazine derivative and the amine compound (II-6) shown in Table 1 in an amount shown in Table 1. Then a dispersion of polyethyl acrylate and 2-hydroxy-4,6-dichloro-1,3,5-triazine sodium salt were added thereto and each of the resulting solutions was coated on a polyethylene terephthalate film in a coated silver amount of 3.5 g/m$^2$.

A gelatin solution was coated on this emulsion layer in a coated gelatin amount of 1 g/m$^2$ as a protective layer.

Each of the thus-obtained samples was exposed for 10 seconds through an optical wedge using a printer of model P-607, made by Dainippon Screen Mfg. Co., Ltd., then developed at 38° C. for 20 seconds using a developer of the following formulation, stopped, fixed, washed with water, and dried.

| Developer formulation (I): | |
|---|---|
| Hydroquinone | 45.0 g |
| N—Methyl-p-aminophenol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| n-Butyldiethanolamine | 15.0 g |
| Water to make | 1 liter |
| | pH = 11.6 |

The results thus obtained are tabulated in Table 1.

TABLE 1

| No. | Emulsion (Rh mol/mol Ag) | Amount of Hydrazine Derivative Added (mol/mol Ag) A | B | C | D | (I-12) | (I-15) | Amount of Amine Compound (II-6) Added (mol/mol Ag) | Relative Sensitivity | γ 1 Day After Coating | γ 20 Days After Storage at 40° C., 80% RH | Remarks |
|---|---|---|---|---|---|---|---|---|---|---|---|---|
| 1 | A(-) | — | — | — | — | — | — | — | 54500 | 6.8 | 6.6 | Comparison |
| 2 | " | — | — | — | — | $5 \times 10^{-4}$ | — | — | 110000 | 12.5 | 11.9 | Comparison |
| 3 | " | — | — | — | — | — | $5 \times 10^{-4}$ | — | 104000 | 12.0 | 11.7 | Comparison |
| 4 | B ($3 \times 10^{-6}$) | $5 \times 10^{-3}$ | — | — | — | — | — | — | 1650 | 11.2 | 8.9 | Comparison |
| 5 | " | — | $5 \times 10^{-3}$ | — | — | — | — | — | 1550 | 10.1 | 9.7 | Comparison |
| 6 | " | — | — | $5 \times 10^{-3}$ | — | — | — | — | 980 | 8.4 | 7.8 | Comparison |
| 7 | " | — | — | — | $5 \times 10^{-3}$ | — | — | — | 1400 | 10.0 | 8.3 | Comparison |
| 8 | " | — | — | — | — | $5 \times 10^{-3}$ | — | — | 1950 | 28.0 | 15.7 | Invent |
| 9 | " | — | — | — | — | — | $5 \times 10^{-3}$ | — | 1900 | 25.7 | 14.2 | " |
| 10 | " | — | — | — | — | $5 \times 10^{-3}$ | — | $8 \times 10^{-4}$ | 2250 | 29.0 | 26.8 | " |
| 11 | " | — | — | — | — | — | $5 \times 10^{-3}$ | $8 \times 10^{-4}$ | 2150 | 27.9 | 25.3 | " |
| 12 | C ($6 \times 10^{-6}$) | $5 \times 10^{-3}$ | — | — | — | — | — | — | 550 | 8.9 | 7.1 | Comparison |
| 13 | " | — | $5 \times 10^{-3}$ | — | — | — | — | — | 500 | 7.8 | 7.0 | Comparison |
| 14 | " | — | — | $5 \times 10^{-3}$ | — | — | — | — | 350 | 7.2 | 6.6 | Comparison |
| 15 | " | — | — | — | $5 \times 10^{-3}$ | — | — | — | 450 | 7.4 | 6.9 | Comparison |
| 16 | " | — | — | — | — | $5 \times 10^{-3}$ | — | — | 630 | 19.3 | 12.3 | Invention |
| 17 | " | — | — | — | — | — | $5 \times 10^{-3}$ | — | 620 | 18.5 | 11.4 | Invention |
| 18 | " | — | — | — | — | $5 \times 10^{-3}$ | — | $8 \times 10^{-4}$ | 730 | 22.5 | 21.3 | Invention |
| 19 | " | — | — | — | — | — | $5 \times 10^{-3}$ | $8 \times 10^{-4}$ | 700 | 21.5 | 20.8 | Invention |
| 20 | D ($3 \times 10^{-5}$) | $5 \times 10^{-3}$ | — | — | — | — | — | — | 86 | 7.8 | 6.5 | Comparison |
| 21 | " | — | $5 \times 10^{-3}$ | — | — | — | — | — | 81 | 7.2 | 6.3 | Comparison |
| 22 | " | — | — | $5 \times 10^{-3}$ | — | — | — | — | 54 | 6.5 | 6.0 | Comparison |
| 23 | " | — | — | — | $5 \times 10^{-3}$ | — | — | — | 76 | 7.1 | 6.2 | Comparison |
| 24 | " | — | — | — | — | $5 \times 10^{-3}$ | — | — | 108 | 12.5 | 7.5 | Invention |
| 25 | " | — | — | — | — | — | $5 \times 10^{-3}$ | — | 103 | 12.1 | 7.0 | Invention |
| 26 | " | — | — | — | — | $5 \times 10^{-3}$ | — | $8 \times 10^{-4}$ | 130 | 15.1 | 14.2 | Invention |
| 27 | " | — | — | — | — | — | $5 \times 10^{-3}$ | $8 \times 10^{-4}$ | 120 | 13.8 | 13.4 | Invention |

Comparative Compounds

A

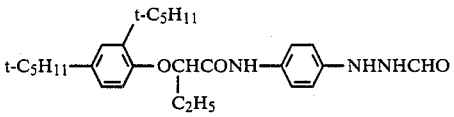

B

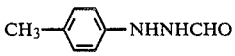

C

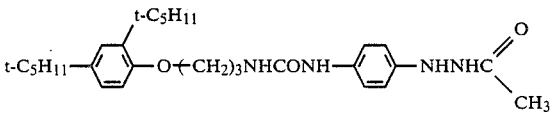

-continued

D

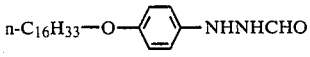

(1) Relative sensitivity: reciprocal number of an exposure amount giving a density of 1.5, taking that of Sample 7 as 1400.

(2) γ: (3.0-0.3)/-{log (an exposure amount giving a density of 0.3) - log (an exposure amount giving a density of 3.0)}

EXAMPLE 2

The same procedures as described in Example 1 were repeated except for changing the developer to a developer of the following formulation (II).

| Developer formulation (I): | |
|---|---|
| Disodium ethylenediaminetetraacetate | 1.0 g |
| Sodium hydroxide | 9.0 g |
| Potassium tertiary phosphate | 74.0 g |
| Potassium sulfite | 90.0 g |
| 3-Diethylamino-1-propanol | 15.0 g |
| N—Methyl-p-aminophenol ½ sulfate | 0.8 g |
| Hydroquinone | 35.0 g |
| 5-Methylbenzotriazole | 0.5 g |
| Sodium bromide | 3.0 g |
| Water to make | 1 liter |
| | pH = 11.6 |

Results thus obtained are tabulated in Table 2.

Comparative Compounds:

A

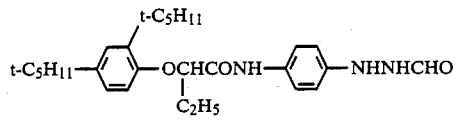

B

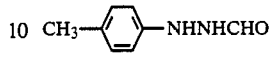

C

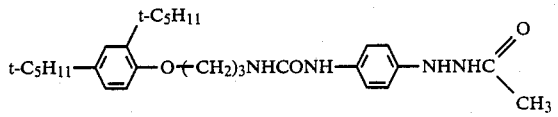

TABLE 2

| No. | Emulsion (Rh mol/mol Ag) | Amount of Hydrazine Derivative Added (mol/mol Ag) A | B | C | D | (I-12) | (I-15) | Amount of Amine Compound (II-6) Added (mol/mol Ag) | Relative Sensitivity | γ 1 Day After Coating | γ 20 Days After Storage at 40° C., 80% RH | Remarks |
|---|---|---|---|---|---|---|---|---|---|---|---|---|
| 1 | A (—) | — | — | — | — | — | — | — | 50000 | 6.6 | 6.5 | Comparison |
| 2 | " | — | — | — | — | $5 \times 10^{-4}$ | — | — | 100000 | 12.0 | 11.5 | Comparison |
| 3 | " | — | — | — | — | — | $5 \times 10^{-4}$ | — | 95000 | 11.8 | 11.4 | Comparison |
| 4 | B ($3 \times 10^{-6}$) | $5 \times 10^{-3}$ | — | — | — | — | — | — | 1500 | 10.8 | 7.8 | Comparison |
| 5 | " | — | $5 \times 10^{-3}$ | — | — | — | — | — | 1400 | 9.8 | 7.8 | Comparison |
| 6 | " | — | — | $5 \times 10^{-3}$ | — | — | — | — | 900 | 7.3 | 6.5 | Comparison |
| 7 | " | — | — | — | $5 \times 10^{-3}$ | — | — | — | 1300 | 9.5 | 7.7 | Comparison |
| 8 | " | — | — | — | — | $5 \times 10^{-3}$ | — | — | 1800 | 25.0 | 13.9 | Invent |
| 9 | " | — | — | — | — | — | $5 \times 10^{-3}$ | — | 1750 | 24.8 | 12.2 | " |
| 10 | " | — | — | — | — | $5 \times 10^{-3}$ | — | $8 \times 10^{-4}$ | 2080 | 28.0 | 25.3 | " |
| 11 | " | — | — | — | — | — | $5 \times 10^{-3}$ | $8 \times 10^{-4}$ | 1980 | 26.0 | 24.8 | " |
| 12 | C ($6 \times 10^{-6}$) | $5 \times 10^{-3}$ | — | — | — | — | — | — | 505 | 8.0 | 6.8 | Comparison |
| 13 | " | — | $5 \times 10^{-3}$ | — | — | — | — | — | 470 | 7.5 | 6.8 | Comparison |
| 14 | " | — | — | $5 \times 10^{-3}$ | — | — | — | — | 320 | 6.9 | 6.5 | Comparison |
| 15 | " | — | — | — | $5 \times 10^{-3}$ | — | — | — | 420 | 7.2 | 6.8 | Comparison |
| 16 | " | — | — | — | — | $5 \times 10^{-3}$ | — | — | 600 | 18.0 | 11.3 | Invention |
| 17 | " | — | — | — | — | — | $5 \times 10^{-3}$ | — | 570 | 17.5 | 10.9 | Invention |
| 18 | " | — | — | — | — | $5 \times 10^{-3}$ | — | $8 \times 10^{-4}$ | 680 | 21.0 | 20.0 | Invention |
| 19 | " | — | — | — | — | — | $5 \times 10^{-3}$ | $8 \times 10^{-4}$ | 650 | 20.5 | 19.8 | Invention |
| 20 | D ($3 \times 10^{-5}$) | $5 \times 10^{-3}$ | — | — | — | — | — | — | 80 | 7.8 | 6.5 | Comparison |
| 21 | " | — | $5 \times 10^{-3}$ | — | — | — | — | — | 75 | 7.0 | 6.3 | Comparison |
| 22 | " | — | — | $5 \times 10^{-3}$ | — | — | — | — | 50 | 6.3 | 6.0 | Comparison |
| 23 | " | — | — | — | $5 \times 10^{-3}$ | — | — | — | 70 | 6.9 | 6.2 | Comparison |
| 24 | " | — | — | — | — | $5 \times 10^{-3}$ | — | — | 100 | 12.0 | 7.8 | Invention |
| 25 | " | — | — | — | — | — | $5 \times 10^{-3}$ | — | 95 | 11.8 | 7.2 | Invention |
| 26 | " | — | — | — | — | $5 \times 10^{-3}$ | — | $8 \times 10^{-3}$ | 120 | 14.0 | 13.5 | Invention |
| 27 | " | — | — | — | — | — | $5 \times 10^{-3}$ | $8 \times 10^{-4}$ | 110 | 13.0 | 12.8 | Invention |

-continued

D

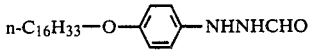

The terms "relative sensitivity" and "$\gamma$" have the same meaning here as in Table 1.

As is apparent from Tables 1 and 2, sensitivity can be reduced to about 1/50 or lower by the addition of the rhodium salt, thus handling properties in a bright room is improved. This reduction in sensitivity is not adversely affected at all by the addition of the hydrazine derivatives of the present invention.

Further, in comparison with the case of using comparative hydrazine derivative compounds (A) to (D), the hydrazine derivatives of the present invention can provide larger gamma values, i.e., provide greater contrast gradations. In addition, even when stored in an environment of high temperature and high humidity, the superhigh contrast gradation remains (compare Sample Nos. 4 to 7 with 8 and 9, 12 to 15 with 16 and 17, and 20 to 23 with 24 and 25, respectively).

Further, the use of amine compound (for example, compound (II-6)) in combination with the hydrazine derivative of the present invention serves to further reduction of the gamma value with time under high temperature and high humidity conditions (Sample Nos. 10, 11, 18, 19, 26 and 27).

Additionally, as is seen from the formulations used in the Examples, even a stable developer containing a comparatively high concentration of the sulfite can provide a superhigh contrast gradation.

Thus, the present invention provides a silver halide photographic material which may be handled in a bright room which possesses superhigh contrast photographic properties and which undergoes less change in gamma with time.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which may be handled in a bright room, which comprises a support having provided thereon at least one silver halide emulsion layer containing silver chlorobromide grains with a bromide contant of not more than 10 mol% of silver chloride grains, said emulsion layer containing $1\times10^{-6}$ mol to $5\times10^{-4}$ mol of a rhodium salt per mol of silver, said emulsion layer being not chemically sensitized, and said emulsion layer of at least one other hydrophiclic colloid layer containing at least one hydrazine derivative represented by the following general formula (I):

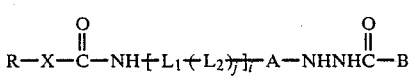

(I)

wherein R represents an organic group having 1 to 30 carbon atoms; A represents a substituted or unsubstituted phenylene group or a substituted or unsubstituted naphthylene group; X represents —NH— or —O—; $L_1$ represents a straight, branched or cyclic alkylene group having 1 to 20 carbon atoms, an aralkylene group having 7 to 20 carbon atoms, a phenylene group, or a divalent group having 1 to 20 carbon atoms, wherein these groups are linked to each other through —O—, —S—, —CO—, —CONH— or —COO—; $L_2$ represents —CONH—, —$SO_2$NH—, —O— or —S—; i and j each independently represents 0 or 1; and B represents a hydrogen atom, a substituted or unsubstituted alkyl group having 1 to 20 carbon atoms, a substituted or unsubstituted phenyl group having 6 to 20 carbon atoms, a substituted or unsubstituted aralkyl group having a total of 7 to 20 carbon atoms and 1 to 3 carbon atoms in the alkyl moiety thereof, a substituted or unsubstituted alkoxy group having 1 to 20 carbon atoms, or a substituted or unsubstituted phenoxy group having 6 to 20 carbon atoms and wherein at least one of said emulsion layer and said at least one other hydrophilic colloid layer contains at least one amine compound represented by the following general formula (II):

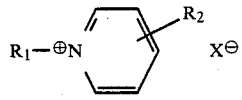

(II)

wherein:

$X^{\ominus}$ represents an anion;

$R_1$ represents —Y—$R_3$, —Y—$COOR_3$, —Y—O-$COR_3$, —Y'—COO—Y—$OCOR_3$, —Y'—OCO—Y—$COOR_3$, or —Y'—COO—Y—-$COOR_3$, wherein Y represents an alkylene group, an arylene group or an aralkylene group; and Y' represents a single bond, an alkylene group, an arylene group or an aralkylene group; $R_3$ represents an alkyl group, an aryl group, an aralkyl group,

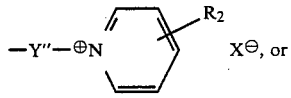

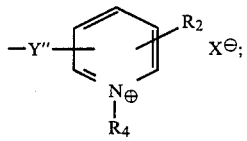

wherein $R_4$ represents an alkyl group, an aryl group or an aralkyl group; Y'' is the same as defined for Y'; and $R_2$ is defined to be the same as $R_1$ above or represents a hydrogen atom, a halogen atom, analkyl group, an aryl group, an aralkyl group, an oxycarbonyl group, an acyloxy group, an alkony group, an amino group, a substituted amino group, an acylamido group, a sulfonamido group, a carbamoyl group, or

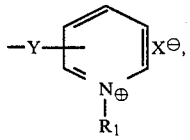

provided that at least one ester exists in $R_1$ or $R_2$.

2. The silver halide photographic material as claimed in claim 1, wherein R represents a substituted or unsubstituted aliphatic, aromatic, or heterocyclic group.

3. The silver halide photographic material as claimed in claim 1, wherein R represents a substituted or unsubstituted alkyl group, a substituted or unsubstituted phenyl group, a substituted or unsubstituted naphthyl group, or a substituted or unsubstituted 5- or 6-membered heterocyclic group which contains at least one of O, N, and S atoms.

4. The silver halide photographic material as claimed in claim 3, wherein the 5- or 6-membered heterocyclic ring is fused to a benzene ring or heterocyclic ring.

5. The silver halide photographic material as claimed in claim 1, wherein at least one hydrazine derivative is represented by the formula (IA)

$$R-X-\overset{\overset{\displaystyle O}{\|}}{C}NH-A-NHNH\overset{\overset{\displaystyle O}{\|}}{C}-H \qquad \text{(IA)}$$

wherein R, A, and X are the same as defined in claim 1.

6. The silver halide photographic material as claimed in claim 1, wherein the hydrazine derivative is present in an amount from $1\times10^{-6}$ to $5\times10^{-2}$ mol per mol of total silver halide.

7. The silver halide photographic material as claimed in claim 6, wherein the hydrazine derivative is present in an amount from $1\times10^{-5}$ to $2\times10^{-2}$ mol per mol of total silver halide.

8. The silver halide photographic material as claimed in claim 1, wherein the amine compound is present in an amount from $1\times10^{-5}$ to $5\times10^{-2}$ mol per mol of total silver halide.

9. The silver halide photographic material as claimed in claim 8, wherein the amine compound is present in an amount from $5\times10^{-5}$ to $1\times10^{-2}$ mol per mol of total silver halide.

10. The silver halide photographic material as claimed in claim 1, wherein the rhodium salt is selected from the group consisting of rhodium chloride, rhodium trichloride, rhodium ammonium chloride, and complex salts thereof.

11. The silver halide photographic material as claimed in claim 1, wherein the rhodium salt is added during grain formation.

12. The silver halide photographic material as claimed in claim 1, wherein the rhodium salt is present in an amount from $1\times10^{-6}$ to $1\times10^{-4}$ mol per mol of silver.

* * * * *